US007268764B2

(12) United States Patent
Song et al.

(10) Patent No.: US 7,268,764 B2
(45) Date of Patent: Sep. 11, 2007

(54) LIQUID CRYSTAL DISPLAY AND DRIVING METHOD THEREOF

(75) Inventors: Hong Sung Song, Kumi-shi (KR); Sang Chang Yun, Daegu (KR)

(73) Assignee: LG.Philips LCD Co., Ltd., Seoul (KR)

( * ) Notice: Subject to any disclaimer, the term of this patent is extended or adjusted under 35 U.S.C. 154(b) by 506 days.

(21) Appl. No.: 10/327,053

(22) Filed: Dec. 24, 2002

(65) Prior Publication Data

US 2003/0197668 A1 Oct. 23, 2003

(30) Foreign Application Priority Data

Apr. 20, 2002 (KR) ..... 2002-21793

(51) Int. Cl.
*G09G 3/36* (2006.01)

(52) U.S. Cl. ..... 345/100; 345/96; 345/98; 345/99

(58) Field of Classification Search ..... 345/55–101, 345/694–698; 349/38
See application file for complete search history.

(56) References Cited

U.S. PATENT DOCUMENTS 4,950,058 A * 8/1990 Diem et al. ..... 349/109
5,107,353 A * 4/1992 Okumura ..... 345/96
5,341,151 A * 8/1994 Knapp ..... 345/88
5,689,283 A * 11/1997 Shirochi ..... 345/88
5,745,093 A * 4/1998 Tsuzuki et al. ..... 345/103
5,875,015 A * 2/1999 Fujiyoshi ..... 349/143
5,966,189 A * 10/1999 Matsuo ..... 349/38
6,650,391 B2 * 11/2003 Chang et al. ..... 349/144
2005/0200585 A1 * 9/2005 Igarashi et al. ..... 345/93

* cited by examiner

*Primary Examiner*—David L. Lewis
(74) *Attorney, Agent, or Firm*—McKenna Long & Aldridge LLP

(57) ABSTRACT

A liquid crystal display and a driving method thereof that are capable of driving a liquid crystal display panel with no flicker using a data driver driven by a column inversion system. In the liquid crystal display, a plurality of liquid crystal cells are positioned at intersections between gate lines and data lines. Color filters are arranged in a zigzag type on the liquid crystal cells on a basis of the data lines. A gate driver drives the gate lines. A data driver applies video signals to the data lines by a column inversion system and shifts said video signals applied to any one of odd horizontal lines and even horizontal lines by one channel to apply said video signals corresponding to the color filters to the liquid crystal cells.

17 Claims, 12 Drawing Sheets

FIG.3A
RELATED ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG.3B
RELATED ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 4A
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 4B
RELATED ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG.5A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.5B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

LIQUID CRYSTAL DISPLAY AND DRIVING METHOD THEREOF

This application claims the benefit of Korean Patent Application No. 2002-21793 filed on Apr. 20, 2002, which is hereby incorporated by reference for all purposes as if fully set forth herein.

BACKGROUND OF THE INVENTION

1. Field of the Invention

This invention relates to a liquid crystal display, and more particularly to a liquid crystal display and a driving method thereof that are capable of driving a liquid crystal display panel with no flicker using a data driver driven by a column inversion system.

2. Discussion of the Related Art

Generally, a liquid crystal display (LCD) controls light transmittance for each liquid crystal cell in the LCD in accordance with a video signal to thereby display a picture. To this end, the LCD includes a liquid crystal display panel having liquid crystal cells arranged in a matrix type and a driving circuit for driving the liquid crystal display panel.

In the liquid crystal display panel, gate lines and data lines are arranged in such a manner to cross each other. A liquid crystal cell is positioned at each area where the gate lines cross the data lines. Each liquid crystal cell is provided with a pixel electrode and a common electrode for applying an electric field. Each pixel electrode is connected, via a thin film transistor as a switching device, to any one of data lines. The gate electrode of the thin film transistor is connected to any one of the gate lines, allowing a pixel voltage signal to be applied to the pixel electrodes for each one line.

The driving circuit includes a gate driver for driving the gate lines, a data driver for driving the data lines, and a common voltage generator for driving the common electrode. The gate driver sequentially applies a scanning signal, that is, a gate signal, to the gate lines to thereby sequentially drive the liquid crystal cells on the liquid crystal display panel one line by one line. The data driver applies a video signal to each of the data lines whenever the gate signal is applied to any one of the gate lines. The common voltage generator applies a common voltage signal to the common electrode. Accordingly, the LCD changes an alignment of the liquid crystal molecules between the pixel electrode and the common electrode in accordance with a voltage applied to each liquid crystal cell to control a light transmittance, thereby displaying a picture.

For instance, as shown in FIG. 1, a related art liquid crystal display includes a liquid crystal display panel 2 having liquid crystal cells arranged in a matrix type, a gate driver 4 for driving gate lines GL1 to GLn of the liquid crystal display panel 2, and a data driver 6 for driving data lines DL1 to DLm of the liquid crystal display panel 2.

In FIG. 1, the liquid crystal display panel 2 includes liquid crystal cells arranged in a matrix type, and thin film transistors (TFTs), each of which are provided at a crossing between the n gate lines GL1 to GLn and the m data lines DL1 to DLm. The TFT applies a video signal from the data line DL1 to DLm to the liquid crystal cell in response to a gate signal from the gate lines GL1 to GLn. The liquid crystal cell can be expressed equivalently as a liquid crystal capacitor Clc including a common electrode opposed to a pixel electrode connected to the TFT with a liquid crystal therebetween. Further, the liquid crystal cell is provided with a storage capacitor (not shown) for maintaining a video signal voltage charged in the liquid crystal capacitor Clc until the next data voltage will be charged.

The storage capacitor is provided between a preceding gate electrode and pixel electrode. The gate driver 4 sequentially applies a gate signal to the gate lines GL1 to GLn to drive the TFT connected to the corresponding gate line. The data driver 6 converts video data into analog video signals to apply video signals for one horizontal line to the data lines DL1 to DLm during one horizontal period when a gate signal is applied to the gate line GL. In this case, the data driver 6 converts the video data into video signals with the aid of gamma voltages from a gamma voltage generator (not shown) to supply them.

Such a liquid crystal display device is provided with a color filter 8 as illustrated in FIG. 2. The color filter 8 includes a plurality of red (R), green (G) and blue (B) filters that are alternately arranged within each row to provide a color in each respective column resulting in a stripe shape. The red (R) color filter is provided on the liquid crystal cells and supplied with a red video data to convert light supplied from the liquid crystal cells into a red color. The green (G) color filter is provided on the liquid crystal cells and supplied with a green video signal to convert light from the liquid crystal cells into a green color. The blue (B) color filter is provided on the liquid crystal cells and supplied with a blue video signal to convert light from the liquid crystal cells into a blue color.

In order to drive the liquid crystal cells on the liquid crystal display panel, such a liquid crystal display uses an inversion driving method such as a frame inversion system, a line (or column) inversion system, or a dot inversion system.

In the frame inversion system, polarities of the video signals applied to the liquid crystal cells on the liquid crystal display panel are inverted whenever a frame is changed.

In the line inversion system, polarities of the video signals applied to the liquid crystal display panel are inverted every gate line of the liquid crystal display and every frame, as illustrated in FIG. 3A and FIG. 3B, respectively. Such a line inversion driving system has a problem in that crosstalk between horizontal pixels exists, causing flicker such as a stripe pattern between horizontal lines.

In the column inversion system, polarities of the video signals applied to the liquid crystal display panel are inverted in accordance with a data line of the liquid crystal display panel and in accordance with a frame, as illustrated in FIG. 4A and FIG. 4B, respectively. Such a column inversion driving system has a problem in that crosstalk between vertical pixels exists, causing flicker such as a stripe pattern between vertical lines.

In the dot inversion system, video signals having polarities opposite to the polarities of the video signals of all adjacent liquid crystal cells in the horizontal and vertical directions are applied to the liquid crystal cells, and the polarities of the video signals are inverted every frame, as illustrated in FIG. 5A and FIG. 5B. In other words, in the dot inversion system, when video signals at the odd-numbered frames are displayed, video signals are applied to the liquid crystal cells such that a positive (+) polarity and a negative (−) polarity are alternated from the left upper liquid crystal cells to the right liquid crystal cells and to the lower liquid crystal cells as illustrated in FIG. 5A; whereas, when video signals at the even-numbered frames are displayed, video signals are applied to the liquid crystal cells such that a positive (+) polarity and a negative (−) polarity are alternated from the left upper liquid crystal cells to the right liquid crystal cells and to the lower liquid crystal cells as illustrated in FIG. 5B. Such a dot inversion driving system cancels flicker occurring between the adjacent pixels, thereby providing more excellent picture quality in comparison to other inversion systems.

However, the dot inversion driving system has a disadvantage in that, since the polarities of the video signals applied from the data driver to the data lines should be inverted in the horizontal and vertical directions, a variation in the amount of the pixel voltage, that is, a frequency of the video signal, is larger than other inversion systems, causing an increase in power consumption.

SUMMARY OF THE INVENTION

Accordingly, the present invention is directed to a liquid crystal display and driving method thereof that substantially obviate one or more of the problems due to limitations and disadvantages of the related art.

Accordingly, it is an advantage of the present invention to provide a liquid crystal display and a driving method thereof that are capable of driving a liquid crystal display panel with no flicker using a data driver driven by a column inversion system.

In order to achieve these and other advantages of the invention, a liquid crystal display device according to an aspect of the present invention includes a plurality of liquid crystal cells positioned at crossings between gate lines and data lines; color filters arranged in a zigzag pattern on the liquid crystal cells; a gate driver for driving the gate lines; and a data driver for applying video signals to the data lines by a column inversion system and for shifting said video signals applied to any one of odd horizontal lines and even horizontal lines by one channel to apply said video signals corresponding to the color filters to the liquid crystal cells.

In the liquid crystal display device, red, green and blue color filters are sequentially provided at intersections between them and the remaining column lines excluding the first column line from the odd horizontal lines while red, green and blue color filters are sequentially provided at intersections between them and the remaining column lines excluding the last column from the even horizontal lines.

Said data driver applies video signals to the remaining data lines excluding the first data line in a driving interval of the odd horizontal lines while applying video signals to the remaining data lines excluding the last data line in a driving interval of the even horizontal lines.

Alternatively, red, green and blue color filters are sequentially provided at intersections between them and the remaining column lines excluding the first column line from the even horizontal lines while red, green and blue color filters are sequentially provided at intersections between them and the remaining column lines excluding the last column from the odd horizontal lines.

Said data driver applies the corresponding video signals to the remaining data lines excluding the first data line in a driving interval of the even horizontal lines while applying the corresponding video signals to the remaining data lines excluding the last data line in a driving interval of the odd horizontal lines.

Said data driver shifts said video signal applied to any one of the odd and even horizontal lines to the right side by one channel.

Said data driver includes a shift register array for sequentially applying a sampling signal; a latch array for latching and outputting a video data in response to said sampling signal; a multiplexor array for outputting said video data as it is or with shifting it by one channel; a digital to analog converter array for converting a video data from the multiplexor array into a video signal having a contrary polarity between adjacent video data; and a buffer array for buffering said video signals to output them to the data lines.

A liquid crystal display device according to another aspect of the present invention includes a plurality of liquid crystal cells positioned at intersections between gate lines and data lines; color filters arranged in a zigzag type on the liquid crystal cells on a basis of the data lines; a gate driver for driving the gate lines; a data driver for converting an input video data into video signals adopting a column inversion system to apply them to the data lines; and a timing controller for controlling the gate driver and the data driver and for applying said video data to the data driver as it is or with shifting it by one clock every horizontal period.

In the liquid crystal display device, red, green and blue color filters are sequentially provided at intersections between them and the remaining column lines excluding the first column line from the odd horizontal lines while red, green and blue color filters are sequentially provided at intersections between them and the remaining column lines excluding the last column from the even horizontal lines.

The timing controller adds a blank signal to the first video data in a driving interval of the odd horizontal lines while adding a blank signal to the last video data in a driving interval of the even horizontal lines, thereby applying them to the data driver.

Alternatively, red, green and blue color filters are sequentially provided at intersections between them and the remaining column lines excluding the first column line from the even horizontal lines while red, green and blue color filters are sequentially provided at intersections between them and the remaining column lines excluding the last column from the odd horizontal lines.

The timing controller adds a blank signal to the first video data in a driving interval of the even horizontal lines while adding a blank signal to the last video data in a driving interval of the odd horizontal lines, thereby applying them to the data driver.

Said timing controller includes a control signal generator for generating control signals for controlling the gate driver and the data driver; a video data aligner for aligning and outputting a video data inputted from the exterior; delay means for receiving the last video data transferred from the video data aligner to delay it by one clock; and a multiplexor for outputting a video data inputted from the video data aligner as it is, or outputting a combination of the last video data at the previous stage outputted via the delay means and said video data inputted from the video data aligner, in response to a multiplexor control signal from the control signal generator.

Said control signal generator senses odd horizontal periods and even horizontal periods using an input horizontal synchronizing signal to generate said multiplexor control signal.

Said video data aligner supplies a video data in a data enable interval while supplying a blank signal in a blank interval between said data enable intervals.

Said multiplexor selects a blank signal stored in the delay means as the first video data in the horizontal period when the previous clock video data is selected.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

A method of driving a liquid crystal display panel according to still another aspect of the present invention includes the steps of applying a video data for one horizontal line including a blank signal as a first video data for each nth horizontal period (wherein n is an odd or even number); applying a video data for one horizontal line including a blank signal as a last video data with shifting it by one channel for each (n+1)th horizontal period; and converting said video data into video signals adopting a column inversion system and applying them to the liquid crystal display panel.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

In the drawings:

FIG. 3A and FIG. 3B are views for explaining a line inversion driving system of the liquid crystal display;

FIG. 4A and FIG. 4B are views for explaining a column inversion driving system of the liquid crystal display;

FIG. 5A and FIG. 5B are views for explaining a dot inversion driving system of the liquid crystal display;

DETAILED DESCRIPTION OF THE ILLUSTRATED EMBODIMENTS

Reference will now be made in detail to embodiments of the present invention, examples of which are illustrated in the accompanying drawings.

Figure 6:
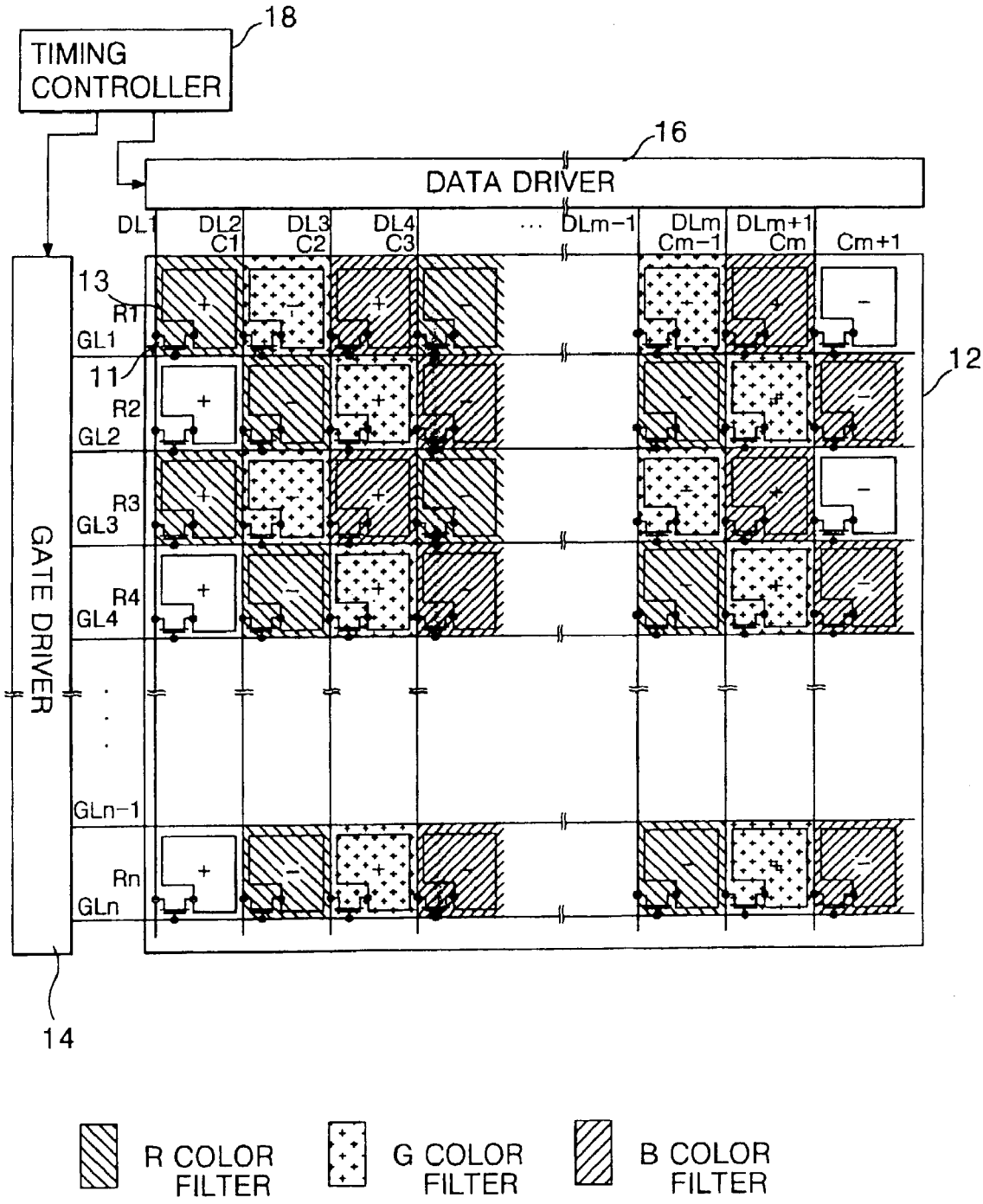
FIG. 6 and FIG. 7 are schematic views illustrating a configuration of a liquid crystal display according to an embodiment of the present invention.

Referring to FIG. 6, there is illustrated a liquid crystal display according to an embodiment of the present invention.

The liquid crystal display includes a liquid crystal display panel 12 having liquid crystal cells arranged in a matrix type, a gate driver 14 for driving gate lines GL1 to GLn of the liquid crystal display panel 12, a data driver 16 for driving data lines DL1 to DLm+1 of the liquid crystal display panel 12, and a timing controller 18 for controlling the gate driver 14 and the data driver 16.

The liquid crystal display panel 12 includes a plurality of gate lines GL1 to GLn and data lines DL1 to DLm+1 provided in such a manner to cross each other. The liquid crystal cells are arranged at crossings between the gate lines GL1 to GLn and the data lines DL1 to DLm+1 in a matrix pattern. Each liquid crystal cell includes a thin film transistor (TFT) 11 connected to any one of the n gate lines GL1 to GLn and any one of the (m+1) data lines DL1 to DLm+1.

Color filters red (R), green (G) and blue (B) are arranged in an alternating or "zigzag" pattern on such liquid crystal cells. In other words, the color filter R, G or B having the same color is arranged in a "zigzag" pattern on a basis of a specific data line DL. Thus, two colors or filter of the red (R), green (G) and blue (B) color filters are alternately arranged in the 2nd and mth column lines C2 to Cm. For example, a red (R) color filter is arranged for each odd-numbered low line R1, R3, R5, . . . at the first column line C1 (i.e., liquid crystal cells connected to the first data line). A blue (B) color filter is arranged for each even-numbered row line R2, R4, R6, . . . at the (m+1)th column line Cm+1.

For instance, the embodiment of the present invention, red (R), green (G) and blue (B) color filters are sequentially provided at intersections between the odd-numbered row lines R1, R3, R5, . . . and the 1st to mth column lines C1 to Cm as illustrated in FIG. 6. In this case, red (R), green (G) and blue (B) color filters also are sequentially provided at intersections between the even-numbered row lines R2, R4, R6, . . . and the 2nd to (m+1)th column lines C2 to Cm+1.

Figure 8:
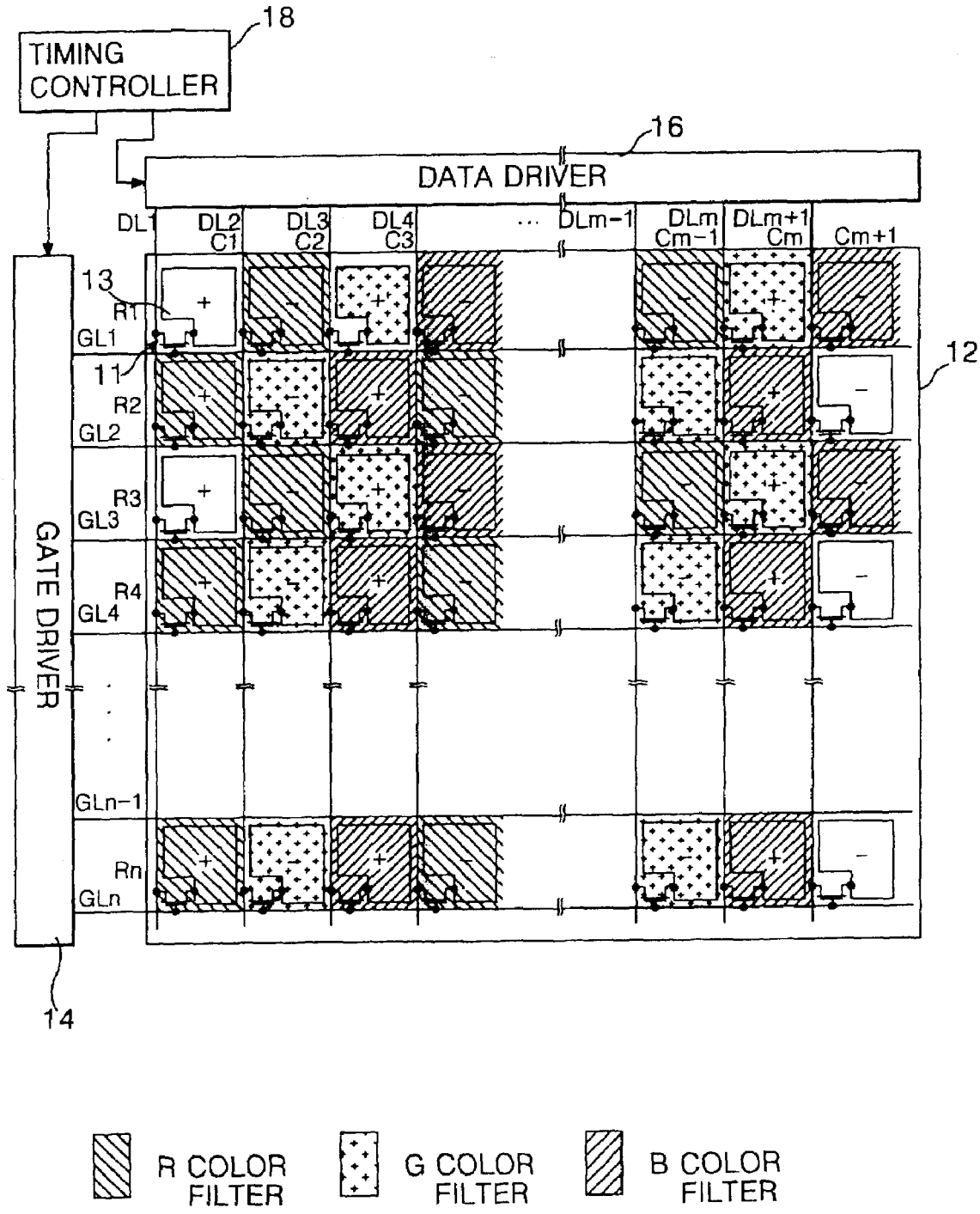
FIG. 8 is a schematic view illustrating a configuration of a liquid crystal display according to another embodiment of the present invention.

Alternatively, red (R), green (G) and blue (B) color filters may be sequentially provided at intersections between the odd-numbered row lines R1, R3, R5, . . . and the 2nd to (m+1)th column lines C1 to Cm+1 as shown in FIG. 8. In this case, red (R), green (G) and blue (B) color filters also may be sequentially provided at intersections between the even-numbered low lines R2, R4, R6, . . . and the 1st to mth column lines C1 to Cm.

The thin film transistor 11 applies a video signal from each data line DL1 to DLm+1 to the liquid crystal cell in response to a gate signal from each gate line GL1 to GLn. The liquid crystal cell drives a liquid crystal positioned between a common electrode (not shown) and a pixel electrode 13 in response to the video signal, thereby controlling a light transmittance.

The gate driver 14 sequentially applies gate signals to the gate lines GL1 to GLn to drive the thin film transistors connected to the corresponding gate lines. The data driver 16 converts video data inputted from the exterior thereof into analog video signals to apply the video signals to the data lines DL1 to DLm+1 when a gate signal is applied from the gate driver 14. In this case, the data driver 16 applies video data for each one horizontal line to the data lines DL1 to DLm+1.

Figure 7:
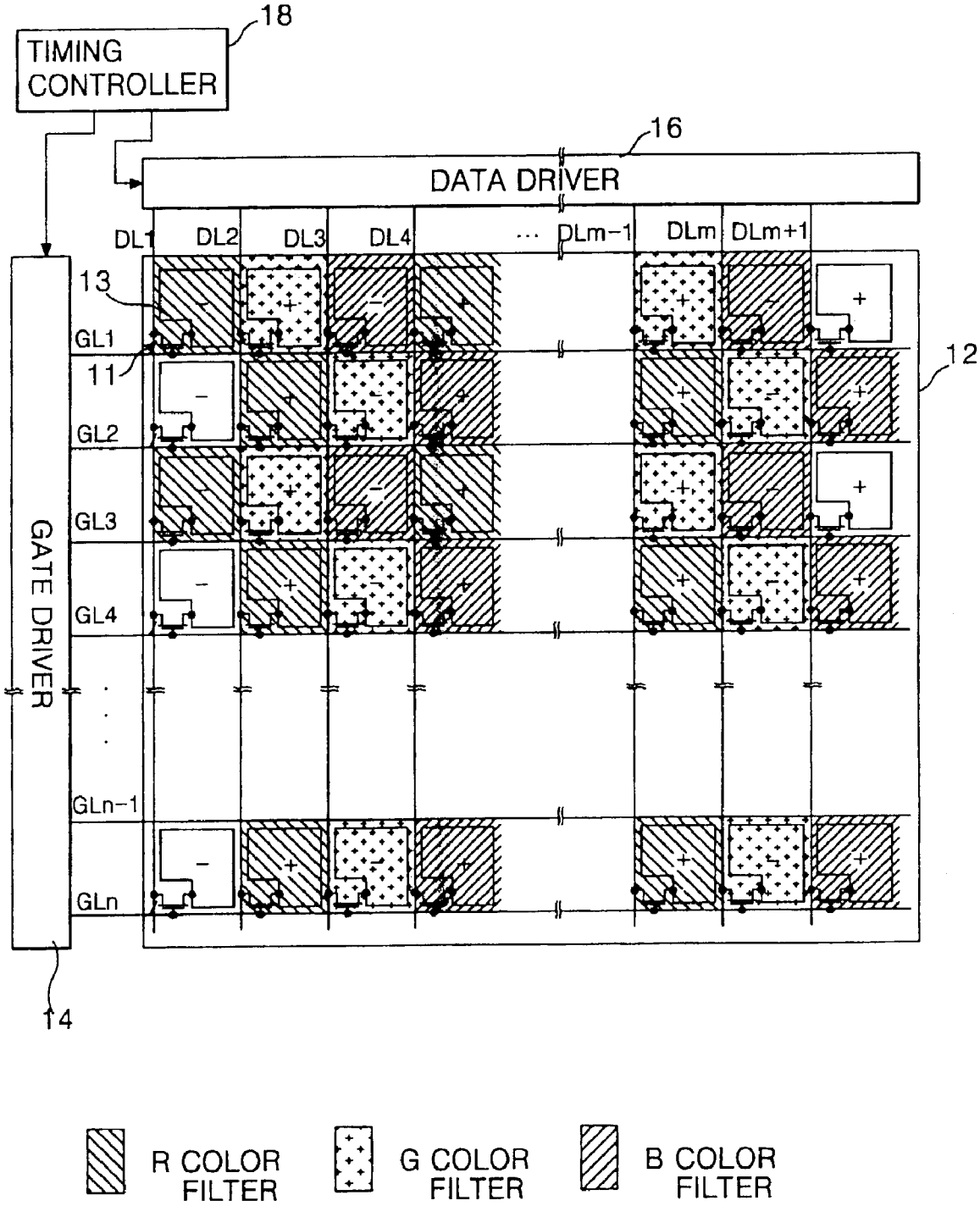

Such a data driver 16 applies the video signals to the data lines DL1 to DLm+1 by a column inversion driving system. In other words, the data driver 16 applies video voltage signals with a opposite polarity to the odd-numbered data lines DL1, DL3, . . . and the even-numbered data lines DL2, DL4, . . . That is to say, the liquid crystal display according to the embodiment of the present invention is supplied with video signals having a different polarity for each data line and for each frame as illustrated in FIG. 6 and FIG. 7 by the "+" and "−" signs in each pixel region.

If video signals are applied to the liquid crystal display by the column inversion system, then the color filter R, G or B having the same color and arranged in adjacently to each other at the upper/lower portion with having the data lines DL therebetween is supplied with video signal having a different polarity. More specifically, first, the green (G) color filter positioned at an intersection between the 2nd column line C2 and the 1st low line R1 is supplied with a negative- or positive-polarity data. Then, the green (G) color filter positioned at an intersection between the 3rd column line C3 and the 2nd low line R2 is supplied with a positive- or negative-polarity data. In other words, the color filters with the same color arranged in adjacent columns and rows and above and below one another and having data lines DL therebetween are supplied with video signals having a different polarity.

If a different polarity of video signal is applied to the color filter R, G or B with the same color arranged in adjacent columns and rows and having data line DL therebetween, then a flicker occurring between adjacent pixels is cancelled to thereby provide a picture having the same quality as the related art dot inversion system. Furthermore, the data driver 16 employing the column inversion system is used, so that it becomes possible to reduce power consumption in comparison to the related art dot inversion system.

In the mean time, the data driver 16 according to the embodiment of the present invention applies a video signal as it is or by shifting it to the right by one channel, for each horizontal period, so that red (R), green (G) and blue (B) video signals can be applied accurately. For instance, when the data driver 16 drives the liquid crystal display panel shown in FIG. 6, video signals applied to the odd-numbered row lines R1, R3, . . . are applied to the 2nd to (m+1)th data lines DL2 to DLm+1, respectively.

More specifically, the data driver 16 applies red (R), green (G) and blue (B) video signals to the 1st to mth data lines DL1 to DLm during one horizontal period when the 1st gate line GL1 (i.e., the 1st row line R1) is driven. Subsequently, the data driver 16 applies red (R), green (G) and blue (B) video signals to the 2nd to (m+1)th data lines DL2 to DLm+1 during one horizontal period when the 2nd gate line GL2 (i.e., the second row line R2) is driven. The video signal is applied as it is or shifted to the right for each row line R (i.e., each gate line GL) as mentioned above, thereby applying a video signal corresponding to the color filter R, G or B to the liquid crystal cell overlapping with the red (R), green (G) or blue (B) color filter.

Otherwise, when the data driver 16 drives the liquid crystal display panel 22 shown in FIG. 8, video signals applied to the odd-numbered row lines R1, R3, . . . are applied to the 2nd to (m+1)th data lines DL2 to DLm+1, respectively. On the other hand, video signals applied to the even-numbered row lines R2, R4, . . . are applied to the 1st to mth data lines DL1 to DLm, respectively.

The timing controller 18 controls driving timing of the gate driver 14 and the data driver 16 and applies a video data signal to the data driver 16.

Figure 9:
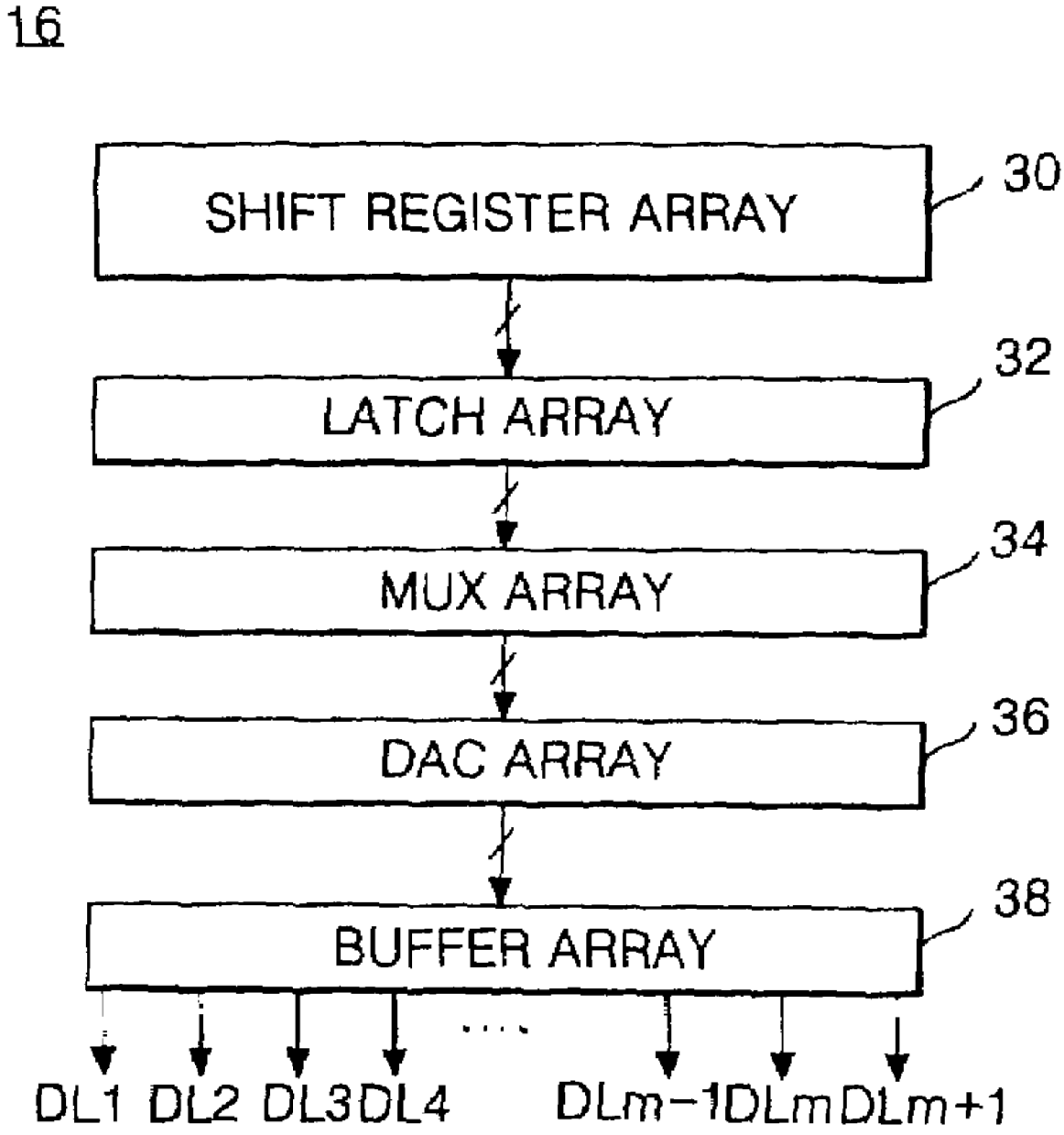
FIG. 9 is a detailed block diagram of the data driver shown in FIG. 7.

FIG. 9 is a detailed block diagram of the data driver shown in FIG. 6.

Referring to FIG. 9, the present data driver 16 includes a shift register array 30 for applying sequential sampling signals, a latch array 22 for latching and outputting video data in response to the sampling signals, a multiplexor (MUX) array 34 for outputting the video data from the latch array 22 as it is or shifting it to the right by one channel, a digital to analog converter (DAC) array 36 for converting the video data from the multiplexor array 34 into video signals, and a buffer array 38 for buffering and outputting the video signals.

The shift register array 30 is comprised of a plurality of shift registers. Such a shift register array 30 sequentially shifts a source start pulse SSP in response to a source sampling clock SSC to output it as a sampling signal.

The latch array 32 is comprised of a plurality of latches. Such a latch array 32 samples a video data supplied from the exterior by a certain unit when a sampling signal is applied and sequentially latches it. Further, the latch array 32 outputs video data in response to a source output enable SOE.

The multiplexor array 34 outputs video data supplied from the latch array 32 as it is or shifted the right by one channel for each horizontal period. To this end, the multiplexor array 34 is comprised of m multiplexors. The m multiplexors receives two adjacent video data and outputs any one of the video data in accordance with a control signal from the timing controller 18.

The DAC array 36 converts the video data from the multiplexor array 34 into video signals using positive and negative gamma voltages from a gamma voltage part (not shown) to output the video signals. At this time, the DAC array 36 converts the odd-numbered and even-numbered video data into video signals having an opposite polarity for a column inversion driving to output the video signals. The buffer array 38 buffers the video signals from the DAC array 36 to output them to the data lines DL1 to DLm+1.

The data driver 16 according to the embodiment of the present invention converts video data into video signals by the column inversion system and shifts the video signals to the right by one channel for each even horizontal period or for each odd horizontal period. Thus, accurate video signals can be applied to a color filter arranged in an alternating or zigzag type. Furthermore, same color filters R, G or B in adjacent columns having a data line DL therebetween are supplied with a different polarity of video signal. As a result, the liquid crystal cells can be driven by the dot inversion system while the data driver 16 is being driven by the column inversion system, so that it becomes possible to reduce power consumption.

Figure 10:
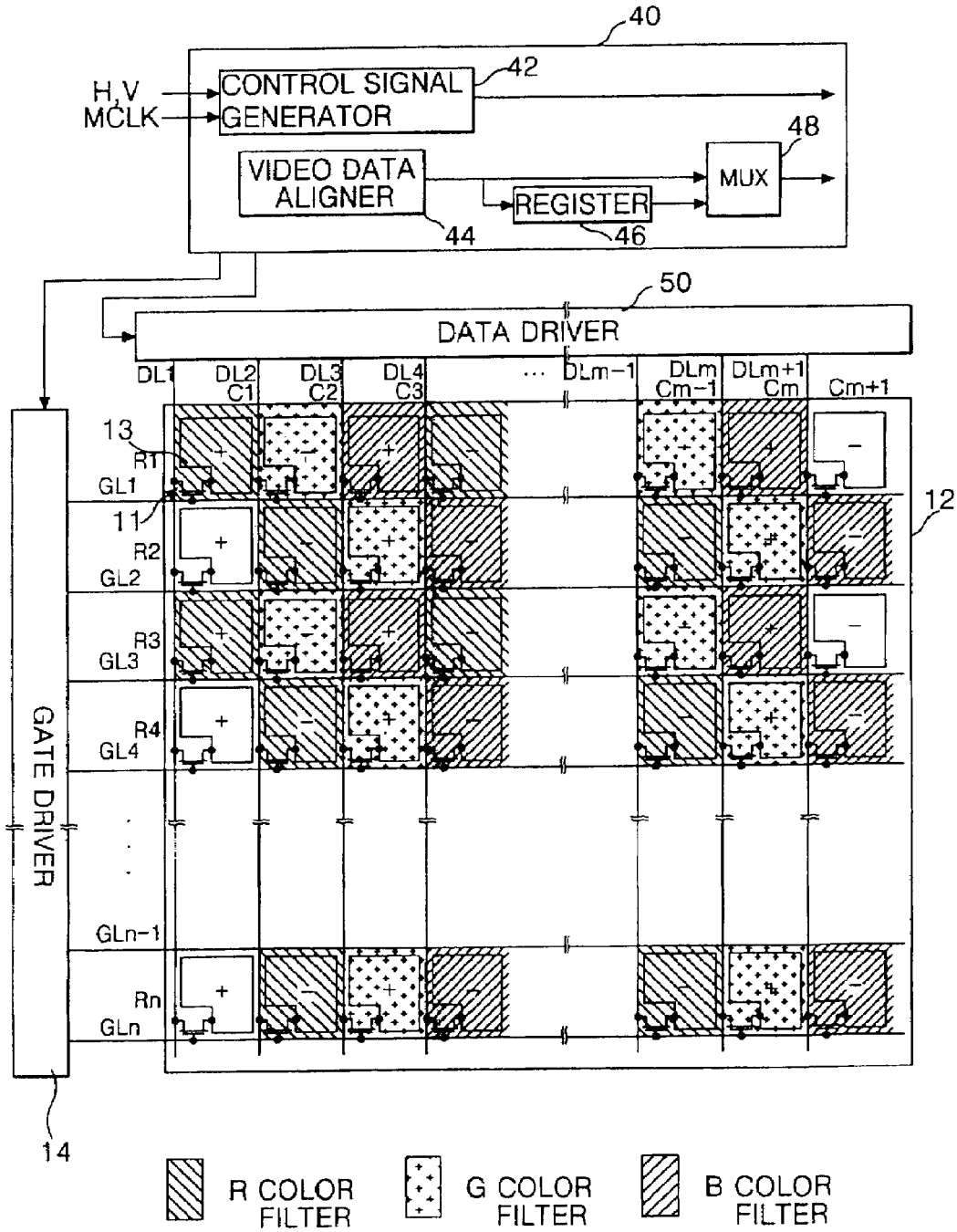
FIG. 10 is a schematic view illustrating a configuration of a liquid crystal display according to still another embodiment of the present invention.

FIG. 10 illustrates a liquid crystal display according to another embodiment of the present invention.

Referring to FIG. 10, the liquid crystal display according to another embodiment of the present invention includes the same elements as the liquid crystal display shown in FIG. 6 except that functions of a timing controller 40 and a data driver 50 are different for the display of FIG. 10.

The liquid crystal display panel 12 includes a plurality of gate lines GL1 to GLn and a plurality of data lines DL1 to DLm+1 crossing each other. Liquid crystal cells are arranged in a matrix type at crossings between the gate lines GL1 to GLn and the data lines DL1 to DLm+1. Each liquid crystal cell includes a thin film transistor 11 connected to any one of the n gate lines GL1 to GLn and the (m+1) data lines DL1 to DLm+1.

Color filters R, G and B are arranged in an alternating or "zigzag" pattern on such liquid crystal cells. In other words, the color filter R, G or B having the same color is arranged in a zigzag type on a basis of a specific data line DL. Thus, two color filters, of red (R), green (G) and blue (B) color filters, are alternately arranged at the 2nd and mth column lines C2 to Cm. A red (R) color filter is arranged for each odd-numbered row line R1, R3, R5, . . . at the first column line C1 (i.e., liquid crystal cells connected to the first data line). A blue (B) color filter is arranged for each even-numbered row line R2, R4, R6, . . . at the (m+1)th column line Cm+1.

The thin film transistor 11 applies a video signal from each data line DL1 to DLm+1 to the liquid crystal cell when a gate signal is applied from each gate line GL1 to GLn. The liquid crystal cell drives a liquid crystal positioned between a common electrode (not shown) and a pixel electrode 13 in response to the video signal, thereby controlling light transmittance.

The gate driver 14 sequentially applies gate signals to the gate lines GL1 to GLn to drive the thin film transistors connected to the corresponding gate lines. The data driver 50 converts a video data inputted from the exterior thereof into analog video signals to apply the video signals to the data lines DL1 to DLm+1 when a gate signal is applied from the gate driver 14. In this case, the data driver 50 applies video data for each one horizontal line to the data lines DL1 to DLm+1.

Such a data driver 50 applies the video signals to the data lines DL1 to DLm+1 by a column inversion driving system. At this time, the data driver 50 applies video signals for one horizontal period to the data lines DL1 to DLm+1.

Such a data driver 50 applies video voltage signals with a contrary polarity to the data lines DL1 to DLm+1 by the column inversion system. In other words, the data driver 50 applies video signals with a contrary polarity to the odd-numbered data lines DL1, DL3, and the even-numbered data lines DL2, DL4, . . . .

If video signals are applied to the liquid crystal display by the column inversion system, then the color filter R, G or B having the same color and arranged in adjacent columns and having the data lines DL therebetween is supplied with video signal having a different polarity. In other words, the color filter R, G or B having the same color arranged adjacently to each other with having the data line DL therebetween is supplied with a different polarity and thus a flicker occurring between adjacent pixels is cancelled, to thereby provide a picture having the same quality as the related art dot inversion system. Furthermore, the data driver 50 employing the column inversion system is used, so that it becomes possible to reduce power consumption in comparison to the conventional dot inversion system.

More specifically, when the data driver 50 drives the liquid crystal display panel 12 shown in FIG. 10, a video signal is applied to each of the 1st to mth data lines DL1 to DLm in a time interval when the odd-numbered row lines R1, R3, . . . are driven. At this time, a blank signal is applied to the (m+1)th data line DLm+1. A video signal is applied to each of the 2nd to (m+1)th data lines DL2 to DLm+1 in a time interval when the even-numbered row lines R2, R4, . . . are driven. At this time, a blank signal is applied to the 1st data line DL1.

Otherwise, when the data driver 50 drives the liquid crystal display panel shown in FIG. 8, a video signal is applied to each of the 2nd to (m+1)th data lines DL2 to DLm+1 in a time interval when the odd-numbered row lines R1, R3, . . . are driven. At this time, a blank signal is applied to the 1st data line DL1. Further, a video signal is applied to each of the 1st to mth data lines DL1 to DLm in a time interval when the even-numbered row lines R2, R4, . . . are driven. At this time, a blank signal is applied to the (m+1)th data line DLm+1.

The timing controller 40 generates control signals for the gate driver 14 and the data driver 50, and applies video data to the data driver 50. Particularly, the timing controller 40 supplies a first data or a (m+1)th data including a blank signal for each low line (R) (i.e., each horizontal period).

To perform such driving, the timing controller 40 includes a control signal generator 42 for generating control signals, a video data aligner 44 for aligning and outputting an input video data, a register 46 for storing the last video data of the video data outputted from the video data aligner 44, and a multiplexor 48 for selectively combining an output of the video data aligner 44 and an output of the register 46.

The control signal generator 42 generates gate control signals (i.e., GSP, GOE and GSC, etc.) for controlling the gate driver 14 and data control signals (i.e., SSP, SSC, SOE and POL, etc.) for controlling the data driver 50. Further, the control signal generator 42 generates a multiplexor control signal for controlling an operation of the multiplexor 48. The multiplexor control signal is generated by sensing odd and even horizontal periods of the horizontal synchronizing signal H.

Figure 11A:
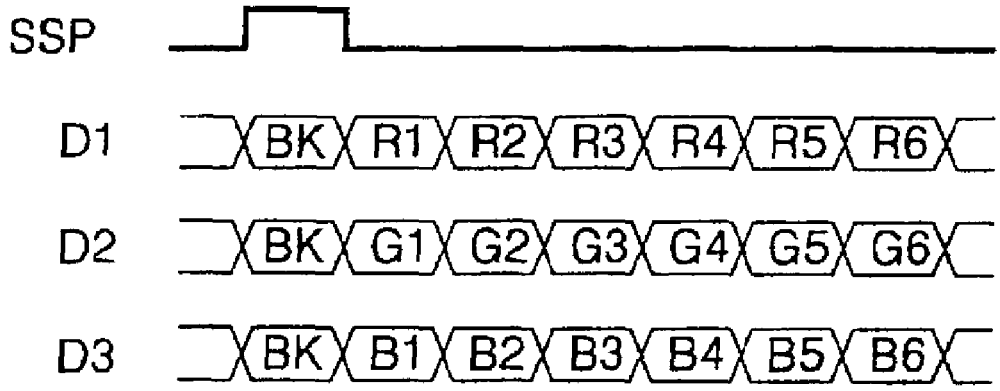
FIG. 11A and FIG. 11B illustrate data outputs of three-bus type of the timing controller shown in FIG. 10.
Figure 11B:
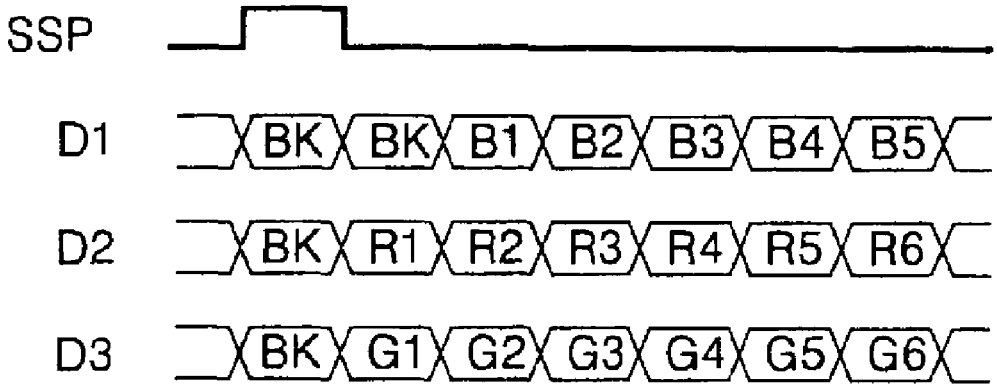
Figure 12A:
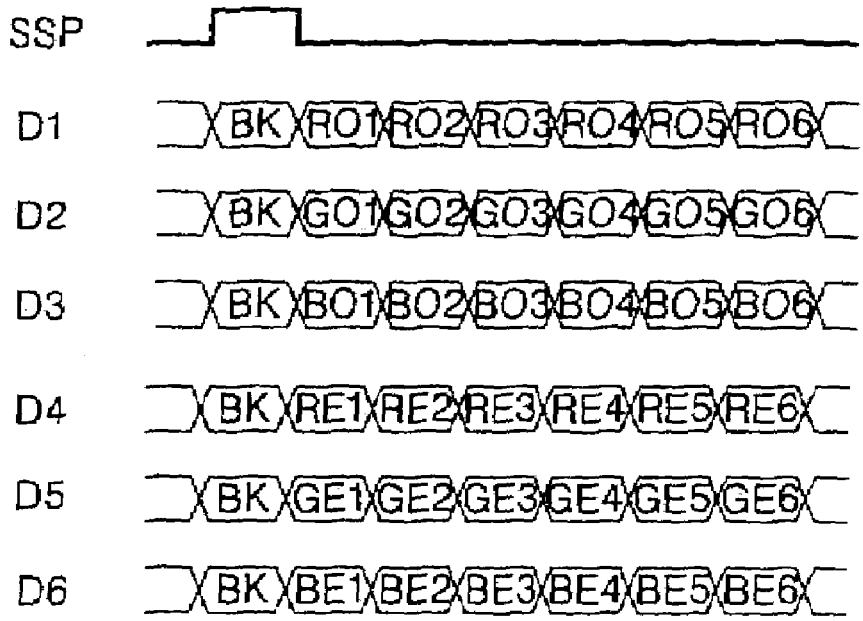
FIG. 12A and FIG. 12B illustrate data outputs of six-bus type of the timing controller shown in FIG. 10.
Figure 12B:
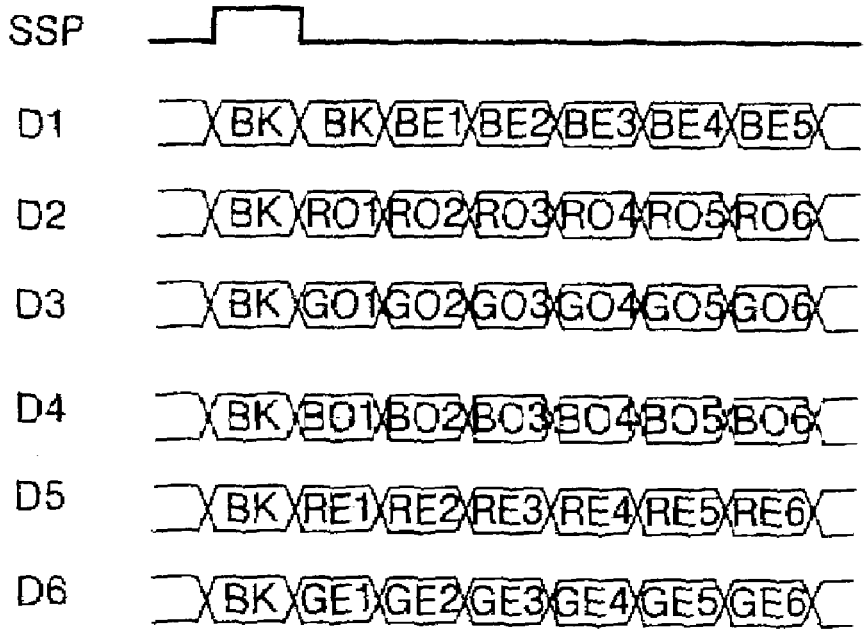

The video data aligner 44 aligns an input video data to output it in accordance with the structure of a data transmission bus. For instance, the video data aligner 44 outputs video data D1, D2 and D3 in a three-bus system as shown in FIG. 11A and FIG. 11B, or outputs video data D1, D2, D3, D4, D5 and D6 in a six-bus system as shown in FIG. 12A and FIG. 12B. Such a video data aligner 44 applies a video data in a data enable interval notifying a data transmission period while applying a blank signal in the remaining blank interval.

Referring again to FIG. 10, the register 46 temporarily stores and outputs a video data transferred via the last bus D3/D6 of video data outputted from the video data aligner 44. Thus, the video data transferred via the last bus D3/D6 is outputted with being delayed by one clock with respect to video data D1, D2/D1, D2, D3, D4 and D5 transferred via other bus.

The multiplexor 48 outputs video data inputted from the video aligner 44 in-situ in accordance with a multiplexor control signal from the control signal generator 42, or selectively outputs the remaining video data excluding video data inputted via the last bus D3/D6 of video data inputted from the video data aligner 44 and a video data on the last bus D3/D6 inputted from the register 46.

FIG. 11A and FIG. 11B are timing charts illustrating when video data is transferred via three buses to the data driver at the timing controller.

In FIG. 11A, red video data R1, R2, R3, . . . , green video data G1, G2, G3, . . . and blue video data B1, B2, B3, . . . are applied, via the first bus D1, the second bus D2 and the third bus D3 of the data driver 50 from the timing controller 40 in a data enable interval. The video data transferred via the first to third buses D1 to D3 includes a blank signal BK applied in a blank interval.

In FIG. 11B, blue video data B1, B2, B3, . . . , red video data R1, R2, R3, . . . and green video data G1, G2, G3, . . . and are applied, via the first bus D1, the second bus D2 and the third bus D3 of the data driver 50 from the timing controller 40 in a data enable interval. In this case, the first data on the first bus D1 includes a blank signal BK.

Figure 1:
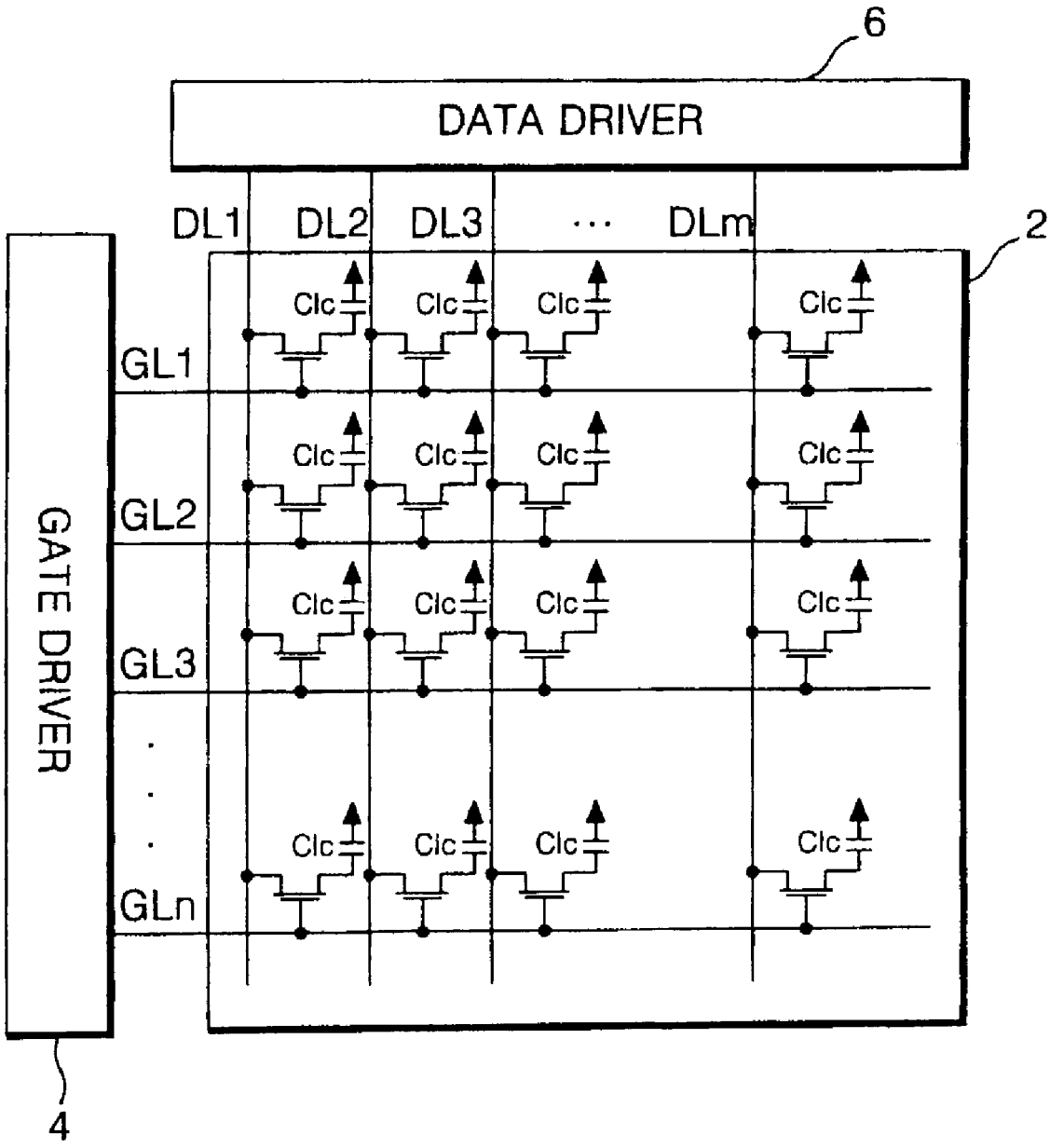
FIG. 1 RELATED ART
FIG. 1 is a schematic view illustrating a configuration of a related art liquid crystal display.
Figure 2:
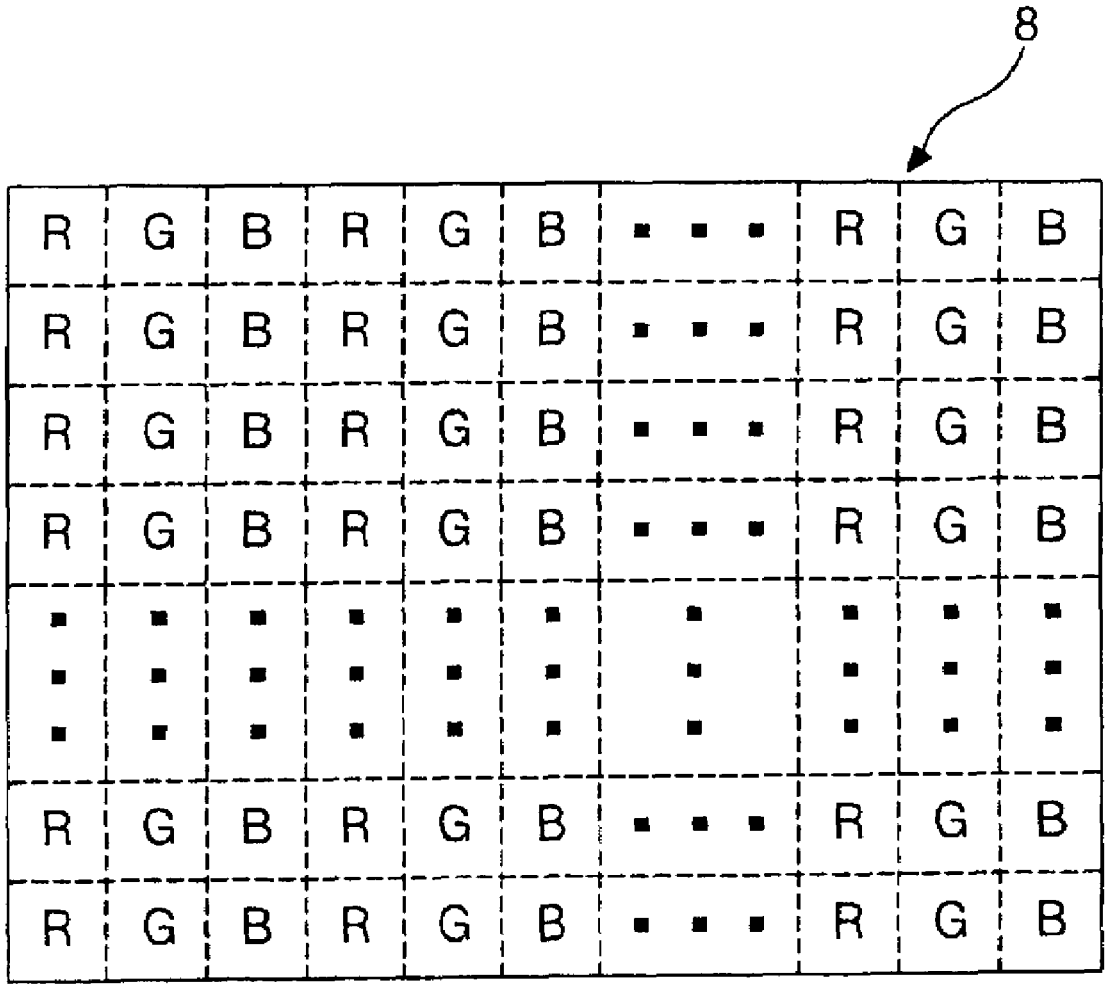
FIG. 2 RELATED ART
FIG. 2 depicts a stripe-type color filter provided in the liquid crystal display shown in FIG. 1.

The multiplexor 48 outputs video data R, G and B via the first to third buses D1 to D3, from the video data aligner 44 to the data driver 50 as they are as shown in FIG. 1A when the multiplexor control signal is an odd horizontal period sensing signal (or an even horizontal period sensing signal). Thus, red (R), green (G) and blue (B) video signals are applied to the first row line R1. At this time, the first red (R1) video signal is applied to the first data line DL1, that is, the first column line C1. Further, the blank signal Bk is applied to the (m+1)th data line DLm+1.

On the other hand, the multiplexor 48 outputs video data R, G and B inputted, via the first to third buses D1 to D3, from the video data aligner 44 and a blank signal BK (i.e., video data transferred via the last bus in the previous horizontal period) stored in the register 46 as shown in FIG. 11B when the multiplexor control signal is an even horizontal period sensing signal (or an odd horizontal period sensing signal). In this case, the blank signal BK, which has been stored in the register 46, is outputted as the first data on the first bus D1. Thus, the blank signal BK is applied to the first data line DL1. Further, at the second row line R2, red (R), green (G) and blue (B), video signals are applied to the 2nd to (m+1)th data lines DL2 to DLm+1.

FIG. 12A and FIG. 12B are timing charts illustrating when video data is transferred via six buses to the data driver at the timing controller.

In FIG. 12A, odd-numbered red video data RO1, RO2, . . . , odd-numbered green video data GO1, GO2, . . . and odd-numbered blue video data BO1, BO2, . . . are applied via the first bus D1, the second bus D2 and the third bus D3 of the data driver 50 from the timing controller 40 in a data enable interval. Further, even-numbered red video data RE1, RE2, . . . , even-numbered green video data GE1, GE2, . . . and even-numbered blue video data BE1, BE2, . . . are applied via the fourth bus D4, the fifth bus D5 and the sixth bus D6 of the data driver 50. The video data transferred via the first to sixth buses D1 to D6 includes a blank signal BK applied in a blank interval.

In FIG. 12B, even-numbered blue video data BE1, BE2, . . . , are applied via the first bus D1 of the data driver 50 from the timing controller 40 in a data enable interval. Further, odd-numbered red video data RO1, RO2, . . . , odd-numbered green video data GO1, G2, . . . and odd-numbered blue video data BO1, B2, . . . are applied via the second to fourth buses D2 to D4. Even-numbered red video data RE1, RE2, . . . and even-numbered green video data GE1, GE2, . . . are applied via the fifth bus D5 and the sixth bus D6. In this case, the first data on the first bus D1 includes a blank signal BK.

Referring again to FIG. 10, the multiplexor 48 outputs video data RO, GO, BO, RE, GE and BE inputted via the first to sixth buses D1 to D6, from the video data aligner 44 to the data driver 50 as they are as shown in FIG. 12A when the multiplexor control signal is an odd horizontal period sensing signal (or an even horizontal period sensing signal). Thus, red (R), green (G) and blue (B) video signals are applied to the 1st to mth data lines DL1 to DLm. Further, the blank signal Bk is applied to the (m+1)th data line DLm+1.

On the other hand, the multiplexor 48 selects any ones of pixel data the first to fifth buses the previous clock pixel data on the sixth bus passing and output them via a different bus as shown in FIG. 12B when the multiplexor control signal is an even horizontal period sensing signal (or an odd horizontal period sensing signal). In this case, the blank signal BK having been stored in the register 46 is outputted as the first data on the first bus D1. Thus, the blank signal BK is applied to the first data line DL1. Thereafter, red (R), green (G) and blue (B) video signals are applied to the 2nd to (m+1)th data lines DL2 to DLm+1.

The timing controller 40 according to another embodiment of the present invention supplies m video data along with the first or last pixel data and the blank signal every data enable interval of the horizontal period. Accordingly, the data driver 50 applies m video data by the column inversion system every horizontal period and, at the same time, applies a blank signal to the first data line DL1 or the (m+1)th data line DLm+1, thereby applying accurate data to the color filters arranged in a zigzag pattern on the liquid crystal display panel 12 or 22.

As described above, according to the present invention, the color filters having the same color are arranged in a zigzag pattern on the basis of the data lines to apply data corresponding to the color filters by the column inversion system, so that it becomes possible to provide a picture having the same picture quality as if a dot inversion system were used. Furthermore, the liquid crystal display panel is driven by the column inversion system, so that it becomes possible to reduce power consumption in comparison to the dot inversion system.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a plurality of liquid crystal cells positioned at crossings between gate lines and data lines;

said liquid crystal cells arranged in straight columns and rows;

color filters arranged by color in a zigzag pattern on the liquid crystal cells;

a gate driver for driving the gate lines; and a data driver for applying video signals to the data lines by a column inversion system and for shifting said video signals applied to any one of odd horizontal lines and even horizontal lines by one channel to apply said video signals corresponding to the color filters to the liquid crystal cells.

2. The liquid crystal display device according to claim 1, wherein red, green and blue color filters are sequentially provided at crossings of odd horizontal lines and the column lines, excluding the first column line, wherein red, green and blue color filters are sequentially provided at crossings of even horizontal lines and column lines, excluding the last column.

3. The liquid crystal display device according to claim 2, wherein said data driver applies video signals to the remaining data lines excluding the first data line while driving the odd horizontal lines and apply as video signals to the data lines excluding the last data line while driving the even horizontal lines.

4. The liquid crystal display device according to claim 1, wherein red, green and blue color filters are sequentially provided at crossings of even horizontal line and column lines, excluding the first column line, where by red, green and blue color filters are sequentially provided at crossings of odd horizontal lines and column lines, excluding the last column.

5. The liquid crystal display device according to claim 4, wherein said data driver applies the corresponding video signals to data lines excluding the first data line while driving the even horizontal lines and applies the corresponding video signals to data lines excluding the last data line while driving the odd horizontal lines.

6. The liquid crystal display device according to claim 1, wherein said data driver shifts said video signal applied to any one of the odd and even horizontal lines to the right side by one channel.

7. The liquid crystal display device according to claim 4, wherein said data driver includes:

a shift register array for sequentially applying a sampling signal;

a latch array for latching and outputting a video data in response to said sampling signal;

a multiplexor array for outputting said video data in-situ or with shifting it by one channel;

a digital to analog converter array for converting a video data from the multiplexor array into a video signal having an opposite polarity between adjacent video data; and a buffer array for buffering said video signals to output them to the data lines.

8. A liquid crystal display device, comprising:

a plurality of liquid crystal cells positioned at intersections between gate lines and data lines, said liquid crystal cells arranged in straight columns and rows;

color filters having like colors arranged in a zigzag type on the liquid crystal cells on a basis of the data lines;

a gate driver for driving the gate lines;

a data driver for converting an input video data into video signals adopting a column inversion system to apply them to the data lines; and a timing controller for controlling the gate driver and the data driver and for applying said video data to the data driver as is and with shifting of said video data by one clock every horizontal period.

9. The liquid crystal display device according to claim 8, wherein red, green and blue color filters are sequentially provided at crossings of odd horizontal lines and the column lines, excluding the first column line, wherein red, green and blue color filters are sequentially provided at crossings of even horizontal lines and column lines, excluding the last column.

10. The liquid crystal display device according to claim 9, wherein the timing controller adds a blank signal to the first video data while driving the odd horizontal lines and adds a blank signal to the last video data while driving the even horizontal lines, thereby applying them to the data driver.

11. The liquid crystal display device according to claim 8, wherein red, green and blue color filters are sequentially provided at crossings of even horizontal line and column lines, excluding the first column line, where by red, green and blue color filters are sequentially provided at crossings of odd horizontal lines and column lines, excluding the last column.

12. The liquid crystal display device according to claim 11, wherein the timing controller adds a blank signal to the first video data while driving the even horizontal lines and adds a blank signal to the last video data while driving the odd horizontal lines, thereby applying them to the data driver.

13. The liquid crystal display device according to claim 8, wherein said timing controller includes:

a control signal generator for generating control signals for controlling the gate driver and the data driver;

a video data aligner for aligning and outputting a video data inputted from the exterior;

delay means for receiving the last video data transferred from the video data aligner to delay it by one clock; and a multiplexor for outputting a video data inputted from the video data aligner in-situ, or outputting a combination of the last video data at the previous stage outputted via the delay means and said video data inputted from the video data aligner, in response to a multiplexor control signal from the control signal generator.

14. The liquid crystal display device according to claim 13, wherein said control signal generator senses odd horizontal periods and even horizontal periods using an input horizontal synchronizing signal to generate said multiplexor control signal.

15. The liquid crystal display device according to claim 13, wherein said video data aligner supplies a video data in a data enable interval while supplying a blank signal in a blank interval between said data enable intervals.

16. The liquid crystal display device according to claim 13, wherein said multiplexor selects a blank signal stored in the delay means as the first video data in the horizontal period when the previous clock video data is selected.

17. A method of driving a liquid crystal display panel having liquid crystal cells provided at intersection between gate lines and data lines, said liquid crystal cells arranged in straight columns and rows, and including color filters arranged in a zigzag type on the liquid crystal cells on a basis of the data lines, comprising the steps of:

applying a video data for one horizontal line including a blank signal as a first video data for each nth horizontal period (wherein n is an odd or even number);

applying a video data for one horizontal line including a blank signal as a last video data with shifting it by one channel for each (n+1)th horizontal period; and converting said video data into video signals adopting a column inversion system and applying them to the liquid crystal display panel.

* * * * *